US005313256A

United States Patent [19]

Bov, Jr. et al.

[11] Patent Number: 5,313,256

[45] Date of Patent: May 17, 1994

[54] ELECTROPHOTOGRAPHIC PRINTER WITH ASSOCIATED EMBOSSING DEVICE

[75] Inventors: Raphael F. Bov, Jr., Pittsford; William C. Howe, Walworth, both of N.Y.

[73] Assignee: Xerox Corporation, Stamford, Conn.

[21] Appl. No.: 15,188

[22] Filed: Feb. 10, 1993

[51] Int. Cl.[5] ..... G03G 15/20; G03G 21/00

[52] U.S. Cl. ..... 355/282; 355/202

[58] Field of Search ..... 355/200, 201, 202, 282, 355/284, 285, 295, 315

[56] References Cited

U.S. PATENT DOCUMENTS

| | | | |
|---|---|---|---|
| 2,243,284 | 5/1941 | Niece | 283/9 |
| 2,285,806 | 6/1942 | Close | 283/9 |
| 3,816,114 | 6/1974 | Fukushima et al. | 355/261 X |
| 4,115,001 | 9/1978 | Mischo et al. | 355/29 |
| 4,364,661 | 12/1982 | Landa | 355/274 |
| 4,417,800 | 11/1983 | Hirose et al. | 355/315 |
| 4,563,086 | 1/1986 | Knapp et al. | 355/285 X |
| 4,588,212 | 5/1986 | Castagnoli | 283/91 |
| 5,036,357 | 7/1991 | Nishimori et al. | 355/321 X |
| 5,060,921 | 10/1991 | Higashio et al. | 355/324 X |
| 5,168,286 | 12/1992 | Okauchi et al. | 355/202 X |
| 5,241,341 | 8/1993 | Okauchi et al. | 355/202 |

*Primary Examiner*—Fred L. Braun
*Attorney, Agent, or Firm*—R. Hutter

[57] ABSTRACT

A device for embossing electrophotographically printed sheets is operatively disposed downstream of a fusing station. The device includes a rotatable member having a relief defined on an edge thereof for pressing into the sheet. The rotatable member is rotated by the same mechanism that drives the fusing station.

9 Claims, 2 Drawing Sheets

FIG. 1
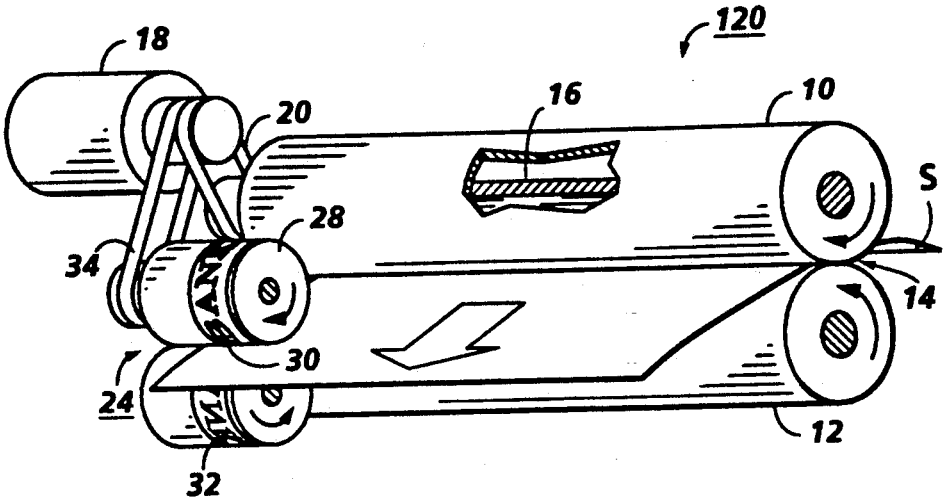
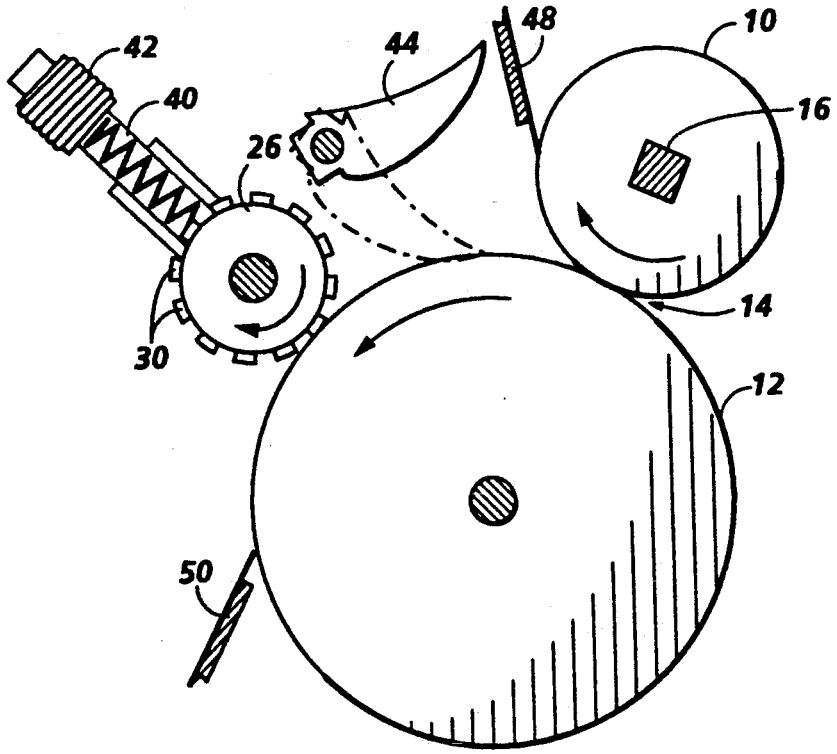
FIG. 2

ELECTROPHOTOGRAPHIC PRINTER WITH ASSOCIATED EMBOSSING DEVICE

The present invention relates to an electrophotographic printer adapted to create magnetically-readable images, such as the magnetic ink character recognition (MICR) characters on checks, having associated therewith a device for embossing the sheet on which the image is printed. This embossing may be used to enhance security procedures associated with printing checks.

In the process of electrophotography, a light image of an original to be copied is typically recorded in the form of a latent electrostatic image upon a photosensitive member. The latent image is then rendered visible by the application of electroscopic marking particles, commonly referred to as toner, to the photosensitive member. The visual image is then transferred from the photosensitive member to a sheet of plain paper and subsequently fused thereto.

In order to fuse the image formed by the toner onto the paper, electrophotographic printers frequently use heat or a combination of heat and pressure. One combination type of fuser which applies heat and pressure fuser includes a heated fusing roll in physical contact with a relatively soft pressure roll. These rolls cooperate to form a fusing n*ip through which the sheet having the image transferred thereto passes.

One type of electrophotographic printing is magnetic ink character recognition (MICR) printing. MICR printing is most familiar in the form of the code numbers on bank checks. These characters are printed with an ink having magnetic component therein, so that, while the characters themselves may be read by the human eye as characters, the shapes or other attributes of the magnetic characters may be detected through a magnetic read-head, in a manner familiar in the art. In electrophotographic MICR printing, the MICR characters are created by using a magnetic toner. When the magnetic toner is fused onto the sheet, magnetically-readable characters are created, which may be used in the printing of checks, among other purposes. U.S. Pat. No. 4,563,086 generally demonstrates a system for creating and monitoring the quality of electrophotographically-created MICR images.

Because MICR images are often used to print checks and other documents of value, it is expectable that additional techniques for enhancing the security of the production and distribution of such documents be included in a system for creating MICR documents. These additional security techniques are generally aimed at making such documents more difficult to forge or counterfeit. Techniques have been proposed for, for example, enmeshing threads of conspicuous color within the sheet itself, or even microencapsulating liquids within the sheet to make the documents more difficult to mutilate. One more common technique for enhancing the security of such documents is to include an embossing step in the document creation process. Such embossing, particularly on a preprinted document, tends to make unauthorized duplication of such a document more difficult. One common example of the security use of embossing is the familiar practice of superimposing an embossed corporate seal over an officer's signature. (As used in the specification and claims herein, the word "embossing" will refer both to the pressing of a portion of the sheet upwards relative to the image on the sheet and to what is more specifically known as "debossing," in which the portion of the sheet is pressed downward from the image side.) Numerous techniques for exploiting the principle of embossing documents of value are shown, for example, in U.S. Pat. Nos. 2,243,284; 2,285,806; and 4,588,212.

According to the present invention, there is provided an apparatus for use in an electrophotographic printer, and preferably a MICR electrophotographic printer, in which the sheet on which the image is printed can be embossed immediately after fusing of the image, for security purposes. The fusing station includes a first roll and a second roll, forming a nip therebetween for the passage of a sheet therethrough. one of the rolls is caused to rotate by a drive mechanism. This drive mechanism also causes the rotation of a rotatable member which is used to emboss a desired image on the sheet being fused. The rotatable member defines a relief therein for pressing into the sheet. This embossing step is preferably performed immediately after the fusing step as the sheet with the image thereon passes through. In one embodiment of the invention, the embossing means uses one of the rolls in the fusing station as a backing roll.

In the drawings:

FIG. 1 is a perspective view showing, in isolation, a fusing station incorporating the present invention;

FIG. 2 is an elevational view of an alternate embodiment of a fusing station incorporating the present invention.

Figure 3:
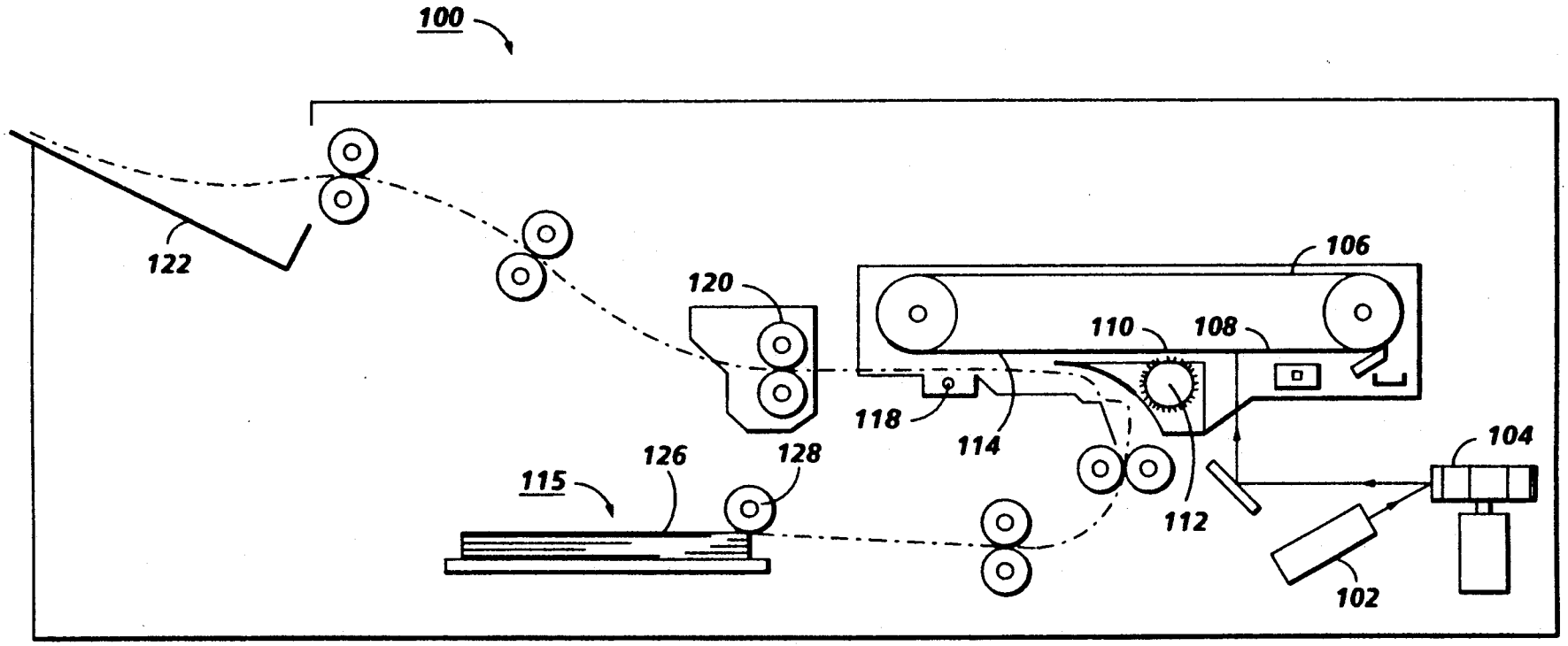
FIG. 3 PRIOR ART
FIG. 3 is an elevational view of an electrophotographic printer.

FIG. 3 shows the basic elements of a typical electrophotographic printer 100. In printer 100, image data relating to a document to be produced is used to modulate a writing beam from source 102. The writing beam is then reflected by the facets of a rotating polygon 104 to create a raster of discharged areas, or "latent image," on the photoreceptor 106 in an image configuration at imaging station 108. The photoreceptor belt 106 then rotates so that the latent image is moved towards development station 110, where a magnetic brush developer system 112 develops the electrostatic latent image into visible form. At developer system 112, magnetic toner is dispensed from a hopper (not shown) and deposited in known manner, such as by magnetic brush development, on the charged area of photoreceptor belt 106 corresponding to the optical image to be reproduced.

The developed magnetic image is transferred at the transfer station 114 from the photoreceptor belt 106 to a sheet of paper or other substrate, which is delivered from a paper supply system, into contact with the belt 106 in synchronous relation to the image thereon. Individual sheets are introduced into the system from a stack of supply paper 126 by a friction feeder 128. A separated sheet from stack 126 is fed, in the embodiment shown, by further sets of nip roll pairs around a 180° path indicated by the broken line. At the transfer station 114, a transfer corotron 118 provides an electric field to assist in the transfer of the magnetic toner particles from the photoreceptor belt 106 to the copy sheet. The image is subsequently fused onto the paper in known manner at fusing station 120 and the finished copy is deposited in hopper 122.

FIG. 1 is a perspective view showing, in isolation, fusing station 120, incorporating the embossing apparatus of the present invention. The typical elements of a fusing station 120, as is familiar in the art, are a heating roll 10 and a pressure roll 12, which are arranged against each other to form a nip 14 for the passage of a sheet S therethrough. Typically, in a design common to low-volume and mid-volume copiers and printers, heating roll 10 includes therein a heating element 16 (shown in the fragmentary sectional view) for generating heat which is transmitted to the image-bearing side of a sheet S in order to partially melt the toner thereon and cause it to be absorbed into the paper of sheet S. In addition to this heating, the pressure between heating roll 10 and pressure roll 12 further causes the partially melted toner to be fixed onto the sheet to form a permanent image. In the particular embodiment shown in FIG. 1, the sheet S is caused to move through the nip 14 by the direct rotation of heating roll 10 by a motor 18. Motor 18 is operatively connected to heating roll 10 by a small belt 20, although other motion-transfer means, such as gears or direct drive, are certainly possible. The pressure of the driven heating roll 10 through sheet S to pressure roll 12 causes the rotation of pressure roll 12, although of course pressure roll 12 may have its own separate driving mechanism as well.

Fuser rolls, whether heating rolls or pressure rolls, are typically in the form of a rotating cylinder, with an outer surface comprising a thin elastomeric layer which contacts the copy material. The outer surface may include a release material, such as the synthetic polymer resin known under the trade name "Teflon," to prevent toner from adhering to the surface of the roll itself. Fuser rolls in common use have outer layers of a thickness on the order of 0.005–0.01 inches, while typical pressures exerted on the outer layer of a fuser roll are on the order of 50 to 150 psi.

According to the present invention, after a toner image on sheet S is fused and fixed by the rollers 10 and 12, the sheet is then substantially immediately sent through an adjacent embossing station shown generally as 24. This embossing station 24 includes an embossing roll 26 and a backing roll 32, adapted to be disposed on the opposite side of a sheet S passing between them. The purpose of embossing station 24 is to press into a sheet S, and preferably into a fused image on the sheet S, a preselected relief image. This relief image may be in the form of a bank logo or some continuous pattern. Embossing roll 26 preferably includes a hard rotatable member 28 forming at least a portion thereof, which has defined on the outer circumference thereof a relief 30. This relief 30, when pressed into the sheet, will cause the desired embossment. The balance of the embossing roller 26 may be smooth, and the embossing roller 26 may or may not extend across the entire width of the sheet S. The relief 30 should be so disposed relative to the sheet S passing therethrough so as not to interfere with the necessary magnetically-readable characters, which, as is known in the art, are of necessity restricted to a line on check in which there is no interference from other characters. The desired embossed image may be a repeating pattern shorter than any individual document, as shown, or if it is expected that a plurality of documents of substantially the same size are to be printed, the rotatable member 28 may be of a circumference so that a particular image in the relief 30 will consistently appear in substantially the same place on each document.

Backing roll 32 may be substantially similar to the embossing roll 26, with the provision that the relief defined on a portion thereof be complementary, in a physical sense, to the relief 30 on the embossing roll 26. Once again, the "embossment" on the document may be up or down relative to the image for either true embossing or debossing. Alternately, a complementary relief portion on backing roll 32 may not be necessary at all; instead, backing roll 32 may be in the form of a pliable substance, such as hard rubber or plastic, which will allow the relief 30 of embossing roll 26 to press slightly into the backing roll through the sheet S, much in the manner of a typewriter roller. The advantage of using a pliable backing roller 32 is both that it is less expensive than providing a complementary relief and also that synchronization between the embossing roll 26 and backing roll 32 is not necessary.

At least one of the embossing roll 26 or backing roller 32 is operatively connected to the same driving mechanism as causes the rotation of one of the fusing rolls 10 or 12 in fusing station 120. Here, as shown, the embossing roll 26 is operatively connected to motor 18 by a belt 34. Once again, either embossing roll 26 or backing roll 32 or both may be operatively connected to the drive mechanism.

FIG. 2 is an elevational view of another embodiment of the present invention, wherein, instead of providing a separate backing roll 32 for the embossing roll 26, a relatively large pressure roll 12 not only serves as a pressure roll for purposes of fusing, but also as a backing roll for the relief 30. FIG. 2 further shows additional features which may be incorporated with the present invention. First, in a general-purpose situation, it may be occasionally desired to cause or not cause the embossment of documents being printed by a particular apparatus. It would be convenient if the embossing could be activated or deactivated as needed by, for example, merely pushing a button on the apparatus. To this end, the embossing roll 26 may be mounted on a selectively engagable member such as that shown by spring-loaded device 40 and electromagnet 42, so that, for example, when electromagnet 42 is de-energized, embossing roll 26 will no longer press relief 30 against the surface of pressure roll 12. Alternately, if embossment is not desired, there may be provided a pivotable stripper finger such as 44, here shown in its inoperative position in solid and its operative position in dotted lines. Placement of the pivotable stripper finger 44 against the surface of pressure roll 12 causes a sheet passing through nip 14 to be diverted from further travel on the pressure roll 12, thereby avoiding the embossing step at the nip between embossing roll 26 and pressure roll 12. When embossing is desired, the pivotable stripper finger 44 is simply moved upward, as shown, and a sheet passing through nip 14 will continue on its path around pressure roll 12 through the nip between embossing roll 26 and pressure roll 12. Of course, whichever path is used by the sheet, whether it is embossed or not, stripper fingers such as 48 and 50 to remove the sheet from either heating roll 10 (to which fused sheets typically adhere) or, alternately, from pressure roll 12 itself after the embossing step. In the embodiment in FIG. 2, as in the previous embodiment, it is preferable that both the fusing portion and the embossing portion of the station in general be driven by the same drive mechanism, be it a dedicated local motor, or a larger motor driving the entire printing system. However, as can be seen, driving of either the heating roll 10 or the pressure roll 12 will cause the rotation of embossing roll 26 when embossing roll 26 Is engaged against pressure roll 12. In this way, a single drive mechanism can be used to rotate all three rolls.

Among the advantages of the present invention is that, because the embossing step takes place immediately after the final creation of the document in the fusing step, there will be no hiatus during which printed, but unembossed, documents could be taken for counterfeiting purposes. Further, because the embossing step is performed either with or immediately after the fusing step, the embossing apparatus may be easily incorporated in, for example, a desktop MICR printing apparatus. Further, the embossing apparatus may be so configured that documents may be embossed or not embossed merely by activating a switch on the control panel of the printer, or by sending relevant instructions with the image data to the printer in the course of a printing job.

While the present invention has been described in connection with a preferred embodiment thereof, it will be understood that it is not intended to limit the invention to that embodiment. On the contrary, It is intended to cover all alternatives, modifications, and equivalents as may be included within the spirit and scope of the invention as defined by the appended claims.

We claim:

1. In an electrophotographic printer, of the type in which a latent image recorded on a photoreceptor is developed with magnetic particles and the magnetic particles are transferred to a sheet, the improvement comprising:

means for permanently fusing the magnetic particles to the sheet; and means, operatively associated with the fusing means, for embossing an embossed image in the sheet after the magnetic particles have been fused to the sheet.

2. A printer as in claim 1, wherein the embossing means includes a rotatable member having a relief formed thereon.

3. A printer as in claim 2, wherein the embossing means further includes a backing roll, the rotatable member and the backing roll forming a nip for the passage of the sheet therethrough.

4. A printer as in claim 3, wherein the backing roll has defined therein means complementary to the relief on the rotatable member.

5. A printer as in claim 2, wherein the fusing means includes a roll, and the rotatable member and the roll of the fusing means form a nip for the passage of a sheet therethrough.

6. A printer as in claim 5, further comprising means for selectably diverting a sheet away from the nip formed by the rotatable member of the embossing means and the roll of the fusing means.

7. A printer as in claim 2, further comprising means for selectably engaging the rotatable member against the sheet.

8. A printer as in claim 2, wherein the rotatable member forms the embossed image in substantially the same portion of the sheet on each sheet passing through the fusing means.

9. A printer as in claim 1, wherein the embossing means is mechanically coupled to the fusing means.

* * * * *